US007191622B1

(12) United States Patent
Walker et al.

(10) Patent No.: US 7,191,622 B1
(45) Date of Patent: Mar. 20, 2007

(54) METHOD FOR KNITTING A DESIGN ON A GARMENT POUCH

(75) Inventors: Ronnie Walker, Aiken, SC (US); Gilbert H. Hine, Jr., Kernersville, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 11/254,279

(22) Filed: Oct. 20, 2005

Related U.S. Application Data

(60) Provisional application No. 60/620,472, filed on Oct. 20, 2004.

(51) Int. Cl.
*D04B 1/26* (2006.01)
*D04B 9/46* (2006.01)

(52) U.S. Cl. ..... 66/180; 66/21

(58) Field of Classification Search ..... 66/178 R, 66/180, 181, 182, 8, 21
See application file for complete search history.

(56) References Cited

U.S. PATENT DOCUMENTS 2,910,852 A * 11/1959 Herbert et al. ..... 66/180
3,085,409 A * 4/1963 Bryant ..... 66/180
3,124,948 A * 3/1964 Levin ..... 66/179
4,253,317 A 3/1981 Howard et al.
5,103,656 A 4/1992 Hanson, II
5,802,877 A 9/1998 Yates et al.
5,823,012 A * 10/1998 Hacskaylo ..... 66/171
6,173,589 B1 1/2001 Hayes, Jr. et al.
6,178,785 B1 1/2001 Samata
6,722,163 B2 4/2004 Ando'

OTHER PUBLICATIONS

David J. Spencer, Knitting Technology, Third Edition, 2001, Woodhead Publishing Limited, Cambridge, England, pp. 94-98 and 265-266.

* cited by examiner

*Primary Examiner*—Danny Worrell
(74) *Attorney, Agent, or Firm*—Kilpatrick Stockton LLP

(57) ABSTRACT

A method for knitting a garment includes knitting a design in the pouch of the garment in a non-reciprocatory manner. Such a method includes knitting a pouch and design in a non-reciprocatory manner with a single yarn feed such that the design is substantially flat. Such a method can include knitting a pouch with a single yarn and knitting a design in the pouch with a separate single yarn. Tuck stitches can be knit on each side of the pouch to secure loose yarn ends. Such a method can be useful for knitting a logo design in the heel pouch of a sock.

13 Claims, 4 Drawing Sheets

METHOD FOR KNITTING A DESIGN ON A GARMENT POUCH

CROSS REFERENCE TO PREVIOUS APPLICATIONS

This application claims priority to now abandoned U.S. Provisional Patent Application No. 60/620,472, filed on Oct. 20, 2004, which is incorporated by reference herein in its entirety.

FIELD OF THE INVENTION

The present invention relates to a method for knitting a design, such as a logo, on the pouch of a garment and garments made by the method. Embodiments of the present invention are advantageous for providing garments, such as socks, having a substantially flat design knit with a single feed in the heel or toe of the socks.

BACKGROUND OF THE INVENTION

It is often desirable to include a brand logo in a manufactured garment for purposes of brand identification and marketing. Brand logos and other indicia can be embroidered onto a finished garment. Embroidering has the disadvantage of adding an extra step in the manufacturing process, which increases the time required to produce each branded garment. The required additional time and materials increases the cost of production for such garments.

In knitted garments, brand logos can be placed in strategic locations for quick and easy observation by garment wearers and others. For example, in a sock, a brand can be knit into the toe and/or heel portions of the sock.

Toe and heel portions of a sock are often knit in a reciprocatory fashion. Three-dimensional "turned" heel and toe "pouches" are knit such that, in the case of double-cylinder knitting machines, the heel section needles are transferred down to knit from the bottom cylinder. A spring take-up holds the surplus yarn as the needles traverse towards the feed on the return oscillation, while a pouch tension equalizer ensures that the pouch fabric is held down on the stems of the knitting needles.

A "pouch" is defined as a portion of a hosiery foot knit with extra courses to accommodate a toe or heel. The pouch may be knit with a single feed while the other feeds are taken out of action. An additional splicing yarn may be inserted in the pouch for reinforcement. Reciprocation of the cylinder is produced by the knitting machine drive, and produces a forward and backward oscillation in the knitting quadrant. Because the changeover is mechanically complex, reciprocatory knitting takes place at approximately two-thirds of the speed of circular knitting. In socks with reciprocated heels and toes knit with a single feed, over a third of the courses will be knit in reciprocatory fashion, which may require over 60 percent of the machine's operating time. This additional knitting time makes pouches knit by reciprocation time-consuming and expensive. In the production of a standard "Y-design" heel pouch, the heel is knit by narrowing to less than all of the knitting needles, for example one-third of the needles remaining in action. As each needle is lifted out of action, the yarn is automatically wrapped over it in the form of a tuck stitch, which makes the heel join stronger. Then, extra yarn is knitted in the center of an inverted "Y" suture-line by widening for a predetermined number of courses, for example twelve courses. Narrowing then occurs again by knitting on less than all of the knitting needles (one third of the needles, for example), after which widening occurs, followed by circular knitting.

As a result of the inefficient process involved in reciprocatory knitting of a sock toe or heel pouch, knitting a logo in such a pouch only adds increased time and expense to production of these socks. In addition, knitting a logo in a sock pouch by reciprocatory knitting has the disadvantage of a limited selection available for adding colored yarns in the pouch.

To address the inefficiency and yarn selection limitations of knitting a pouch by reciprocation, sock pouches can be knitted in a non-reciprocatory fashion. Non-reciprocatory knitting of sock pouches is less time consuming and thus more cost-effective than reciprocatory knitting of pouches. However, single-feed, non-reciprocated pouches are disadvantageous for commercial production of socks because yarns in such pouches tend to be too bulky in the finished pouch and cut yarn ends tend to show in a manner displeasing to consumers.

Thus, there is a need to provide a garment, such as a sock, having a pouch knit in a non-reciprocatory manner that includes a design knit in manner acceptable to consumers. There is also a need for a sock having a pouch knit in a non-reciprocatory manner that includes a design knit with a single yarn feed and that is substantially flat and without loose yarn ends.

SUMMARY OF THE INVENTION

The present invention provides a method for knitting a design, such as a logo, on the pouch of a garment and garments made by the method. Embodiments of the present invention include a pouch knit in a non-reciprocatory manner that includes a design knit on the pouch with a single yarn feed such that the design is substantially flat and without loose yarn ends.

In an embodiment, a method for knitting a garment includes knitting the garment on a circular knitting machine knitting cylinder. Knitting may be initiated by knitting all yarn feeds on all needles on the knitting cylinder. Alternatively, knitting may be initiated by knitting on selected needles, for example, less than all of the needles. At a pre-determined location in the garment, a pouch can be formed by knitting one yarn feed continuously on all needles in a non-reciprocatory manner. At the same time, the remainder of all yarn feeds are knit on half or less of all needles. A design can be knit at a pre-determined location in the pouch with a single yarn feed, which is different than the continuously knit yarn feed. In this manner, the design can be knit as a substantially flat design. The design can be knit with a yarn having a color different that the color of the continuously knit yarn. The knitting machine may be programmed to knit the design at the pre-determined location in the pouch. After the pouch is formed, knitting can be resumed on all yarn feeds on all needles to knit the remainder of the garment.

In an embodiment, the pouch can include tuck stitches to secure loose yarn ends. Tuck stitches may be provided in the pouch by decreasing, in successive revolutions on the knitting cylinder, the number of needles that are knitting at a pre-determined location on each side of the pouch. Tuck stitches are introduced in correspondingly increasing numbers at the pre-determined location on each side of the pouch. Tuck stitches may be knit with a single yarn feed that is different than the continuously knit yarn feed and the design yarn feed. In an embodiment, tuck stitches may be knit with two, three, four, or five needles.

In another embodiment, the pouch can be formed by knitting continuously with between two yarn feeds and two less than all yarn feeds on all needles in a non-reciprocatory manner. For example, the pouch can be knit with a total of four or five yarn feeds. Two yarn feeds would be reserved, one feed for the design yarn and one feed for the yarn for tuck stitches.

An embodiment includes a garment made by such a method of the present invention. Such a garment may include a pouch formed from a single, continuously knit yarn in a non-reciprocatory manner. The garment may have a substantially flat design, such as a logo, knit at a pre-determined location in the pouch with a single yarn different than the continuously knit yarn. The garment pouch can include tuck stitches formed on each side of the pouch with a single yarn different than the continuously knit yarn and the design yarn. The design yarn may be a color different that the color of the continuously knit yarn. In a particular embodiment, the garment is a sock, the pouch comprises a heel pouch and a heel shield that extends above the heel pouch, and the design is knit in the heel shield.

Features of a method for knitting a design on the pouch of a garment, and a garment made by the method, of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A method of the present invention for knitting a design on a pouch provides numerous advantages over prior methods. For example, the present invention advantageously provides a garment, such as a sock, having a pouch including a design, such as a logo, knit in a non-reciprocatory manner that is acceptable in appearance and fit to consumers.

Another advantage is that the present invention provides a garment having a pouch knit in a non-reciprocatory manner that includes a design knit with a single yarn feed and that is substantially flat and without loose yarn ends.

Another advantage is that the present invention provides a sock having a pouch with a design knit in a cost-effective manner.

As will be realized by those of skill in the art, many different embodiments of a method for knitting a design on a garment pouch, and a garment made by the method, according to the present invention are possible. Additional uses, objects, advantages, and novel features of the invention are set forth in the detailed description that follows and will become more apparent to those skilled in the art upon examination of the following.

DETAILED DESCRIPTION

The present invention provides a method for knitting a design in the pouch of a garment and garments made by the method. Embodiments of the present invention include a garment pouch knit in a non-reciprocatory manner that includes a design, such as a logo, knit in the pouch with a single yarn feed such that the design is substantially flat and without loose yarn ends. FIGS. 1–4 illustrate such embodiments.

Figure 1:
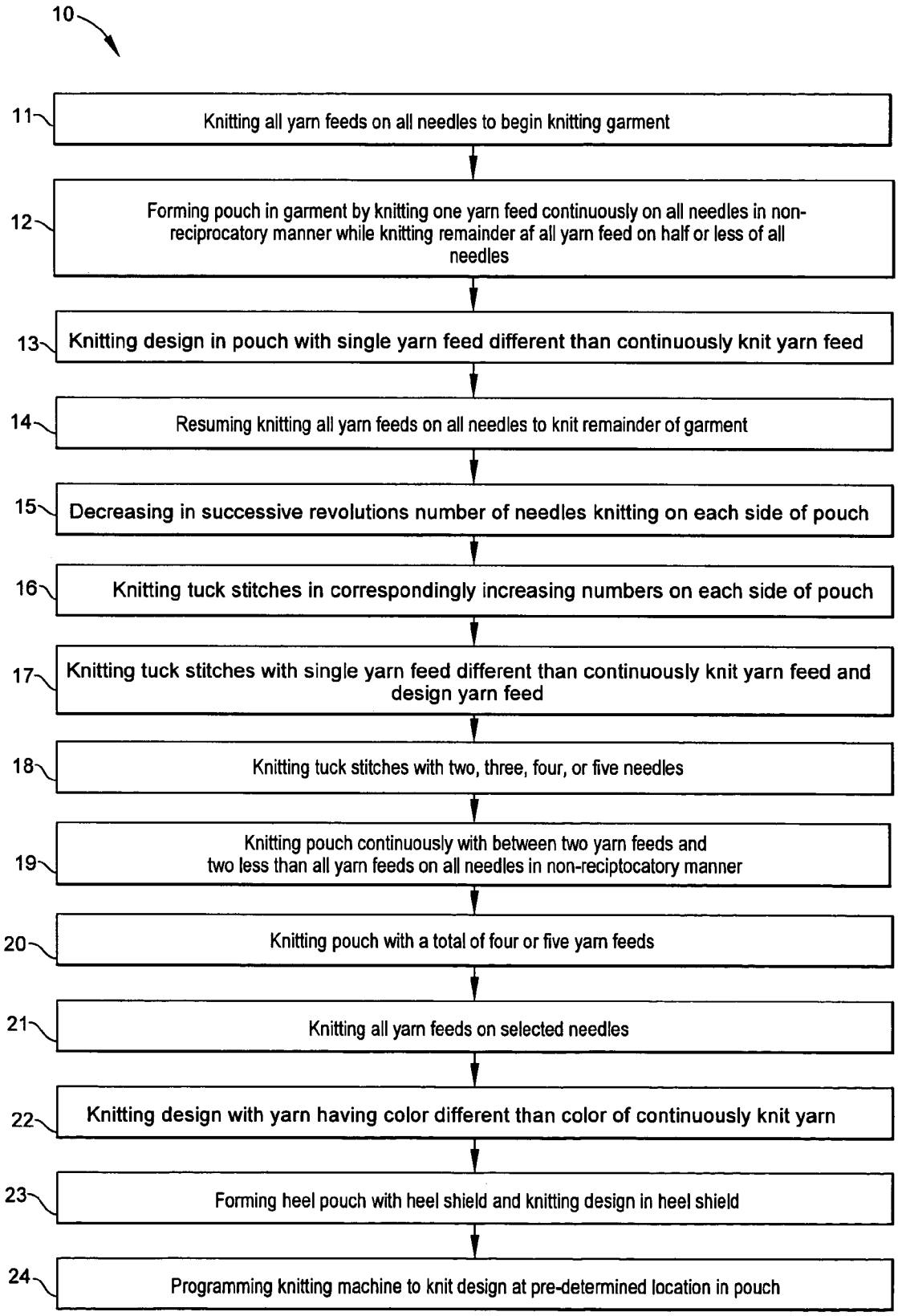
FIG. 1 is a flow chart of a method for knitting a garment having a pouch and a design knit in the pouch in an embodiment of the present invention.
Figure 2:
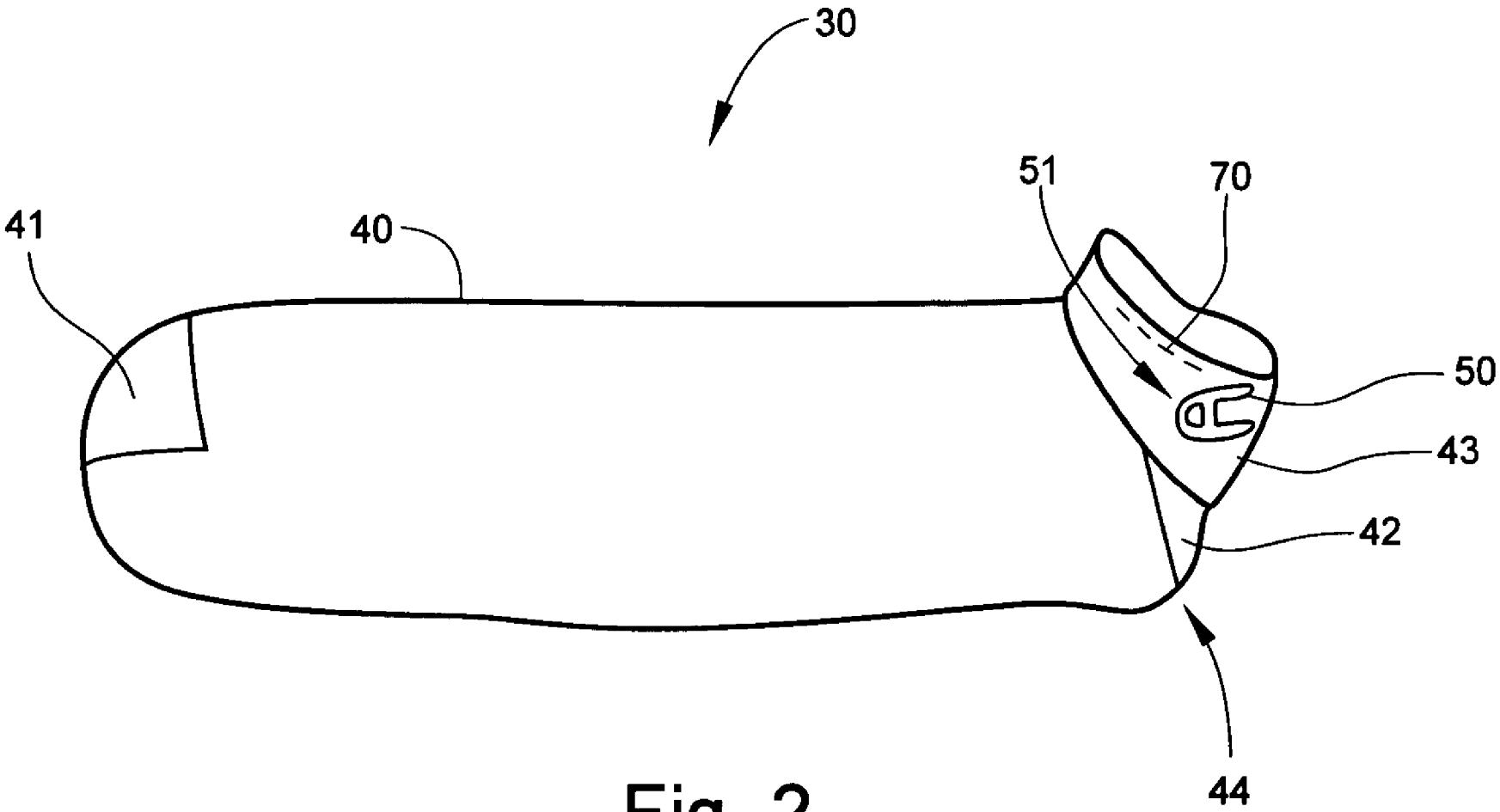
FIG. 2 is a view a sock having a design knit with a single yarn feed in the heel shield of a heel pouch in a non-reciprocatory manner in an embodiment of the present invention.
Figure 3:
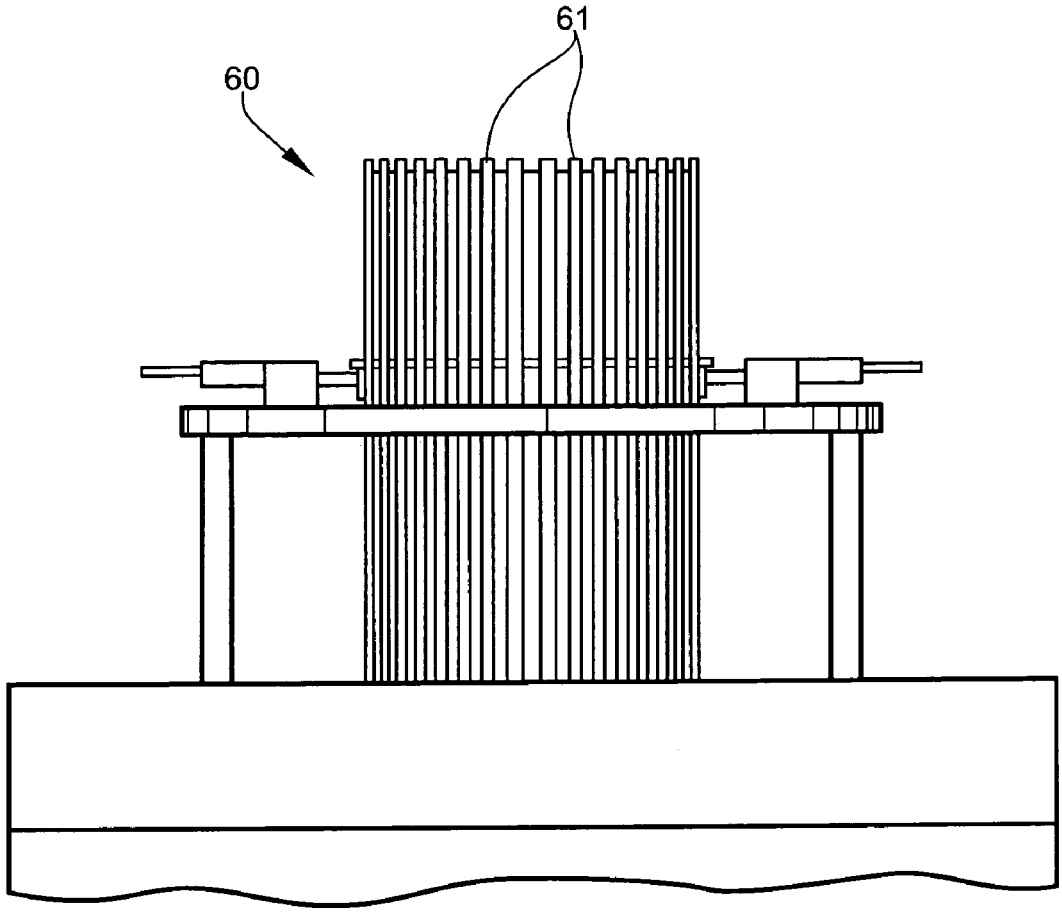
FIG. 3 is a diagrammatic view of knitting needles arranged about a knitting cylinder useful for knitting a garment in an embodiment of the present invention.
Figure 4:
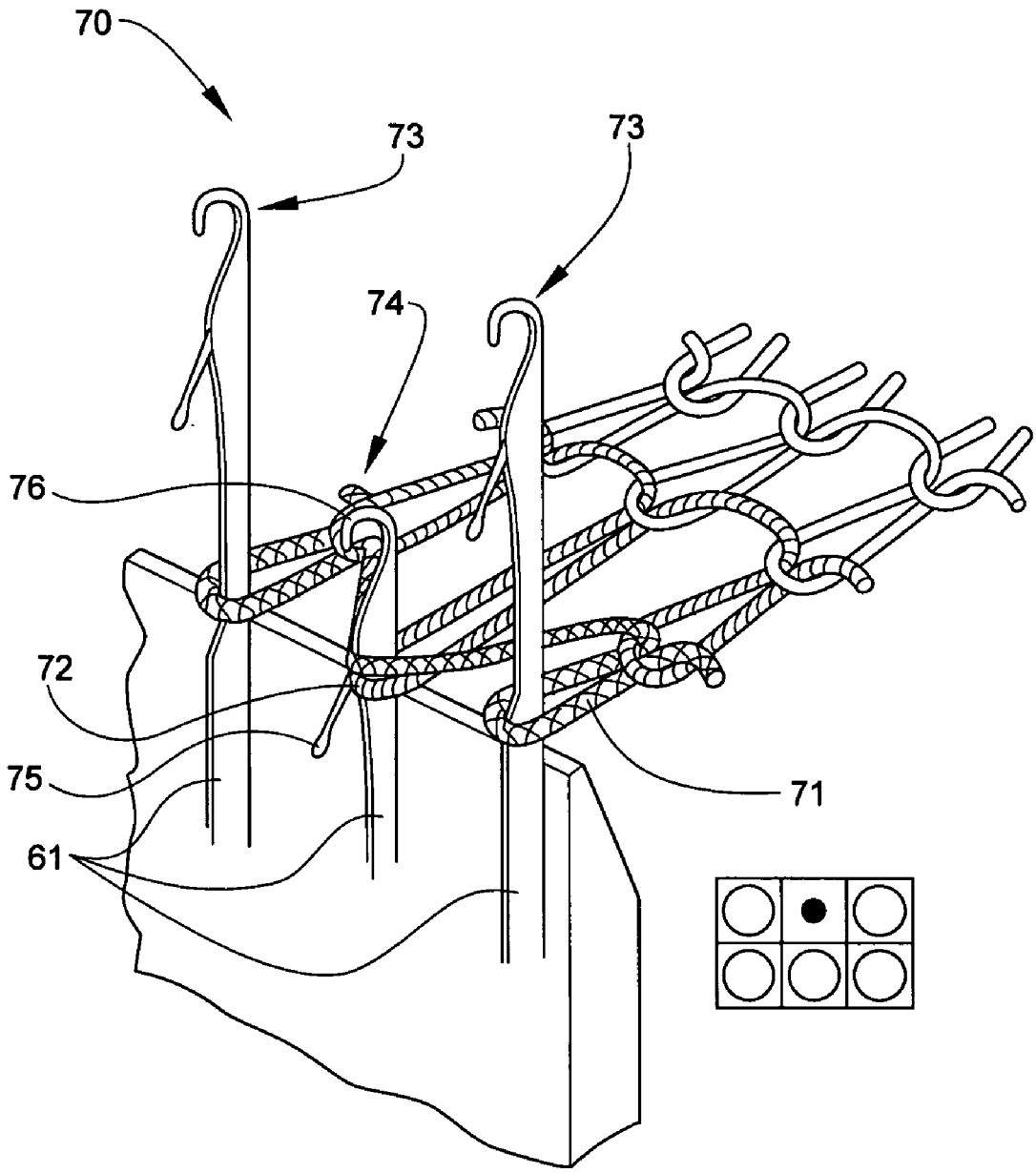
FIG. 4 is a diagrammatic view of a tuck stitch useful in non-reciprocatory knitting of a design in a pouch in an embodiment of the present invention.

As shown in the embodiments in FIGS. 1 and 2, a garment 30 can have a pouch 41, 42 knit in the garment 30. The garment 30 can be, for example, a sock 40, as shown in FIG. 2. In an embodiment of the present invention, the tubular garment 30 can be knit on a standard circular knitting machine. In a circular knitting machine, sets of knitting needles 61 are arranged around the circumference of a knitting cylinder 60, as shown in FIG. 3. A knitting needle 61 can include a hook 76 and a latch 75, as shown in FIG. 4, and can move vertically in the knitting cylinder 60 to hook yarn from a yarn source, or yarn feed, and form loops. Interlocking loops of yarn form the tubular garment 30.

In an embodiment of the present invention, a method 10 for knitting the garment 30 may include initiating knitting (11), for example, a jersey stitch, all yarn feeds on all needles 61 on the knitting cylinder 60. Alternatively, knitting may be initiated by knitting (21) on selected needles 61, for example, less than all of the needles 61. At a pre-determined location 44 in the garment 30, a pouch 42 can be formed (12) by knitting one yarn feed continuously on all needles 61 in a non-reciprocatory manner. At the same time, the remainder of all yarn feeds are knit (12) on half or less of all needles 61. This selection provides the extra yarn needed to form a gradually larger portion, or pouch 41, 42. A design 50 can be knit (13) at a pre-determined location 51 in the pouch 42 with a single yarn feed, which is different than the continuously knit yarn feed. In this manner, the design 50 can be knit as a substantially flat design. The design 50 can be knit (22) with a yarn having a color different that the color of the continuously knit yarn. The knitting machine may be programmed (24) to knit the design 50 at the pre-determined location 51 in the pouch. After the pouch 42 is formed, knitting (14) can be resumed on all yarn feeds on all needles 61 to knit the remainder of the garment 30.

In an embodiment, the pouch 41, 42 can include tuck stitches 70 to secure loose yarn ends. Tuck stitches 70 may be provided in the pouch 41, 42 by decreasing (15), in successive revolutions on the knitting cylinder 60, the number of needles 61 that are knitting at a pre-determined location on each side of the pouch 41, 42. Tuck stitches 70 are introduced (16) in correspondingly increasing numbers at the pre-determined location on each side of the pouch 41, 42. Tuck stitches 70 may be knit (17) with a single yarn feed that is different than the continuously knit yarn feed and the design yarn feed. In an embodiment, tuck stitches 70 may be knit (18) with two, three, four, or five needles 61.

Tuck stitches 70 can be knit at pre-determined locations in the pouch, as shown in FIG. 2, to tie in loose ends of the yarns. A tuck stitch 70 is defined as a knitting stitch that produces tuck or openwork effects by having certain needles 61 hold more than one stitch at a time. FIG. 4 shows the operation of knitting needles 61 to produce a tuck stitch 70. The needles 61 are in a knitting position, or height 73, when raised, and in a tuck position, or height 74, when lowered, as shown in FIG. 4. The tuck stitch 70 can be produced by raising the latch 75 of the knitting needle 61 far enough to receive a new yarn for a tuck loop 71 below the hook 76 but without the old yarn loop, or held loop 72, sliding below the latch 75 of the needle 61, such that when the needle 61 recedes, both the new tuck loop 71 and the old held loop 72 are retained.

Tuck stitches 70 an be knit utilizing only a single yarn feed. The tuck stitch yarn feed is separate from the single yarn feed being used to knit the pouch 41, 42 body. To secure, or lock in, loose yarn ends, two to five tuck needles 61 can be employed on each side of the knitting cylinder 60 (and thus on each side of the sock) to create tuck stitches 70. Tucks of yarn ends can be knitted inside a welt. Once the tuck stitches 70 are formed and knitting of the pouch 41, 42 is completed, all yarn feeds (for example, five yarn feeds), or a selected number of yarn feeds, can be knit continuously on all needles 61 to knit the remainder of the garment 30. In this manner, the design 50 can be knit in the pouch 41, 42 with a single yarn feed such that the design 50 is substantially flat and without loose yarn ends.

In another embodiment, the pouch 41, 42 can be formed by knitting (19) continuously with between two yarn feeds and two less than all yarn feeds on all needles 61 in a non-reciprocatory manner. For example, the pouch 41, 42 can be knit (20) with a total of four or five yarn feeds. Two yarn feeds would be reserved, one feed for the design 50 yarn and one feed for the yarn for tuck stitches 70.

As shown in the embodiment in FIG. 2, a method for knitting the design 50 in the pouch 41, 42 of the sock 40 in a non-reciprocatory manner with a single yarn feed may include knitting (23) the design 50 in a portion of the sock heel pouch 42 that extends above the typical heel pouch 42 toward the calf of the leg. Such a heel pouch 42 extension can be referred to as a "heel shield 43," and can be used by a wearer to pull the sock 40 onto the wearer's foot. In an embodiment of the sock 40 according to the present invention, the non-reciprocatorily knit heel pouch 42 comprises the "heel shield 43" having the design 50, knit from a single yarn feed, that extends above a shoe line such that the design 50 is visible when worn with a shoe.

In an embodiment of the present invention, the design 50 can be a logo. In other embodiments, the design 50 knit from a single yarn feed can be words, names, numbers, or other indicia. A circular knitting machine can be programmed to include a knit pattern for a particular design. Programming can include knitting yarns of different colors for the design 50.

An embodiment of the present invention includes a garment 30 made by such a method. Such a garment 30 may include a pouch 41, 42 formed from a single, continuously knit yarn in a non-reciprocatory manner. The garment 30 may have a substantially flat design 50, such as a logo, knit at the pre-determined location 51 in the pouch 41, 42 with a single yarn different than the continuously knit yarn. The garment pouch 41, 42 can include tuck stitches 70 formed on each side of the pouch 41, 42 with a single yarn different than the continuously knit yarn and the design yarn. The design yarn may be a color different that the color of the continuously knit yarn. In a particular embodiment, a shown in FIG. 2, the garment 30 can be the sock 40, the pouch comprises the heel pouch 42 and the heel shield 43 that extends above the heel pouch 42, and the design 50 is knit in the heel shield 43.

Although the present invention has been described with reference to particular embodiments, it should be recognized that these embodiments are merely illustrative of the principles of the present invention. Those of ordinary skill in the art will appreciate that a method for knitting a design on a pouch, and a garment made by the method, of the present invention may be constructed and implemented in other ways and embodiments. Accordingly, the description herein should not be read as limiting the present invention, as other embodiments also fall within the scope of the present invention.

What is claimed is:

1. A method for knitting a garment, comprising:

knitting all yarn feeds on all needles on a circular knitting machine knitting cylinder to begin knitting the garment;

at a pre-determined location in the garment, forming a pouch by knitting one yarn feed continuously on all needles in a non-reciprocatory manner while knitting the remainder of all yarn feeds on half or less of all needles;

knitting a design at a pre-determined location in the pouch with a single yarn feed different than the continuously knit yarn feed; and when the pouch is formed, resuming knitting all yarn feeds on all needles to knit the remainder of the garment.

2. The method of claim 1, wherein forming the pouch further comprises decreasing, in successive revolutions on the knitting cylinder, the number of needles that are knitting at a pre-determined location on each side of the pouch; and knitting tuck stitches in correspondingly increasing numbers at the pre-determined location on each side of the pouch.

3. The method of claim 2, wherein knitting tuck stitches further comprises knitting tuck stitches with a single yarn feed different than the continuously knit yarn feed and the design yarn feed.

4. The method of claim 2, wherein knitting tuck stitches further comprises knitting tuck stitches with two, three, four, or five needles.

5. The method of claim 1, wherein forming the pouch further comprises knitting continuously with between two yarn feeds and two less than all yarn feeds on all needles in a non-reciprocatory manner.

6. The method of claim 1, wherein forming the pouch further comprises knitting the pouch with a total of four or five yarn feeds.

7. The method of claim 1, wherein knitting all yarn feeds further comprises knitting all yarn feeds on selected needles, the selected needles being less than all needles.

8. The method of claim 1, wherein knitting the design further comprises knitting the design with a yarn having a color different that a color of the continuously knit yarn.

9. The method of claim 1, wherein the garment comprises a sock and forming the pouch further comprises forming in the sock a heel pouch and a heel shield that extends above the heel pouch, and wherein knitting the design further comprises knitting the design in the heel shield.

10. The method of claim 1, further comprising programming the knitting machine to knit the design at the predetermined location in the pouch.

11. The method of claim 1, wherein the design comprises a substantially flat design.

12. The method of claim 1, wherein the design comprises a logo.

13. A method for knitting a garment, comprising:

knitting all yarn feeds on selected needles on a circular knitting machine knitting cylinder to begin knitting the garment;

at a pre-determined location in the garment, forming a pouch by knitting one yarn feed continuously on all needles in a non-reciprocatory manner while knitting the remainder of all yarn feeds on half or less of the selected needles;

knitting a substantially flat design in the pouch with a single yarn feed different than the continuously knit yarn feed, the design yarn having a color different that a color of the continuously knit yarn;

decreasing, in successive revolutions on the knitting cylinder, the number of needles that are knitting at a pre-determined location on each side of the pouch;

knitting tuck stitches with a single yarn feed in correspondingly increasing numbers at the pre-determined location on each side of the pouch, the tuck stitch yarn feed being different than the continuously knit yarn feed and the design yarn feed; and when the pouch is formed, resuming knitting all yarn feeds on the selected needles to knit the remainder of the garment.

* * * * *